United States Patent [19]

Shah

[11] Patent Number: 5,018,964

[45] Date of Patent: May 28, 1991

[54] REMOTE-CONTROLLED GAS BARBEQUE IGNITING SYSTEM

[76] Inventor: Reza H. Shah, 1176 Rutherford Road, Maple, Ontario, Canada, L6A 1S2

[21] Appl. No.: 548,821

[22] Filed: Jul. 6, 1990

[51] Int. Cl.[5] ..... F23Q 9/08

[52] U.S. Cl. ..... 431/45; 431/46

[58] Field of Search ..... 431/45, 46, 47

[56] References Cited

U.S. PATENT DOCUMENTS

| | | | |
|---|---|---|---|
| 2,388,130 | 10/1945 | Eskin et al. | 431/45 |
| 4,070,143 | 1/1978 | Dietz | 431/46 |
| 4,194,875 | 3/1980 | Hewitt | 431/45 |
| 4,359,315 | 11/1982 | Matthews | 431/45 |
| 4,915,614 | 4/1990 | Geary | 431/46 |

*Primary Examiner*—Carroll B. Dority

*Attorney, Agent, or Firm*—David W. Wong

[57] ABSTRACT

A remote-controlled system for igniting a gas barbeque unit and the like is shown. The system controls the gas flow to the pilot lighter and the burner of the barbeque unit, and generates a spark to ignite the pilot lighter and in turn the burner. The system will automatically shut off when the pilot lighter is accidentally extinguished so as to prevent gas leakage to cause any explosion. The system may be operated by a low voltage 9-volt battery.

12 Claims, 4 Drawing Sheets

REMOTE-CONTROLLED GAS BARBEQUE IGNITING SYSTEM

BACKGROUND OF THE INVENTION

This invention relates to a system for igniting a gas barbeque unit and the like and particularly relates to a fail-safe system operative for igniting an outdoor barbeque unit safely and remotely.

Barbeque units, particularly outdoor gas barbeque units use combustible gas fuel such as propane gas or natural gas which are highly volatile. Such gas fuel may present the danger of an explosion, if the barbeque unit is not ignited properly. The danger of explosion is even more threatening when the barbeque unit has to be ignited in a windy condition with its top lid closed. Due to the closed lid condition once the gas is turned on, the barbeque unit must be ignited immediately otherwise the un-ignited gas will fill the entire cavity of the barbeque unit quickly, and when ignited in such circumstances an explosion of the unit can occur. Such condition may also occur when the flame in the unit is accidentally extinguished such as by strong wind and the gas will again continue to fill the cavity of the unit to present an explosion danger when it is re-ignited. For the above reasons, it has been most threatening for the user in igniting a gas barbeque unit.

SUMMARY OF THE INVENTION

It is the principal object of the present invention to provide a system which is operative to control the gas flow in a barbeque unit and to ignite the same effectively.

It is another object of the present invention to provide a low voltage system which can be operated by a low voltage battery.

It is yet another object of the present invention to provide a gas barbeque ignition system which operates in a fail-safe manner.

DETAILED DESCRIPTION OF THE PREFERRED EMBODIMENTS

Figure 1:
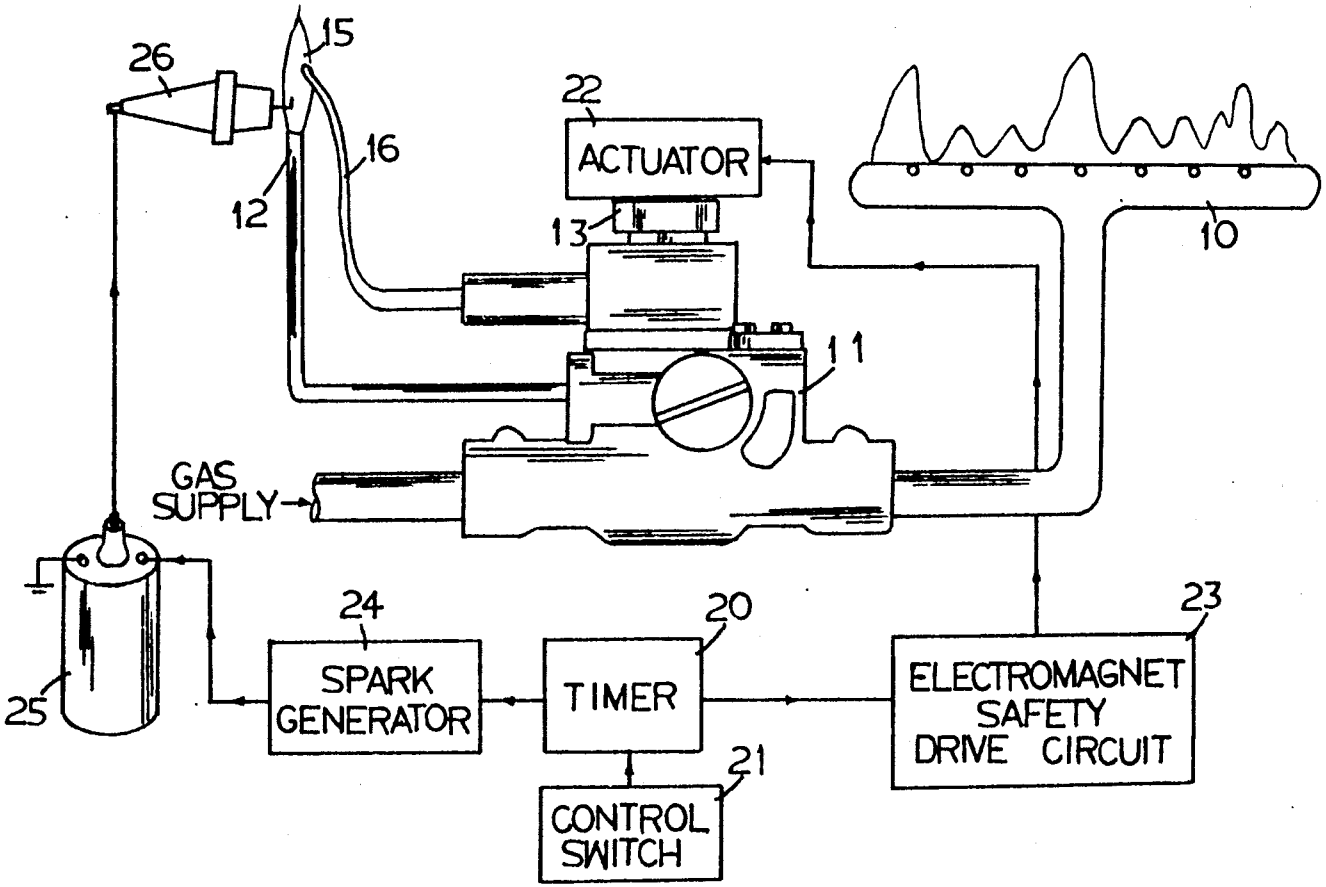
FIG. 1 is a partial block and diagrammatical representation of the gas barbeque igniting system according to the present invention.

With reference to the drawings wherein corresponding parts are identified with the same reference numerals and/or alphabets, the gas supply to a gas burner 10 in a gas barbeque unit is controlled by a thermomagnetic safety valve 11. The safety valve 11 includes a pilot gas nozzle 12. Gas is supplied to the pilot gas nozzle 12 when the manual control button 13 is depressed so that the pilot flame 15 may then be ignited. The existence of the pilot flame 15 is detected by the thermocouple 16 which upon heated by the pilot flame 15 for a preset time period it will set the main valve in the safety valve 11 in a ready state for permitting the combustible gas from the supply source to flow to the burner 10 when the control button 13 is subsequently released while the pilot flame 15 is on; and the gas emitting from the burner 10 may thus be ignited by the pilot flame 15. After the burner 10 has been ignited, the heated thermocouple 16 will continue to maintain the main valve open for the gas to flow continuously to the burner 10 for burning. If the pilot flame is extinguished while the burner 10 is ignited, the thermocouple 16 will cool down to cause, in turn, the main valve in the safety valve 11 to close so that the flow of the gas to the burner is terminated, resulting that the flame at the burner 10 becoming extinguished. The control system according to the present invention is an electromagnetic circuit in combination with the safety valve 11 to provide the desirable remote-controlled ignition system. The central control of the system comprises a timer/-control unit 20 which may be actuated by a control switch 21. The control switch 21 may be a manually operated switch or a switch controlled by a remote-controlled system such as that described in the U.S. Pat. No. 4,924,564 by Reza H. Shah. The timer/control unit 20 regulates the operation of an electromagnetic actuator 22 via a driver circuit 23 to depress the control button 13 of the safety valve 11 so as to allow gas to flow to the pilot gas nozzle 12. In the meantime, the timer/control unit 20 also regulates a spark generator 24 to generate the spark voltage to flow through the ignition coil 25 to the spark plug 26 for producing the spark to ignite the gas emitting through the pilot light nozzle 12 so as to provide the pilot flame 15. The electromagnetic actuator 22 will be maintained for a predetermined time period corresponding to the length of time required for the thermocouple 16 to be heated to set the main valve in the safety valve 11 in the ready state to allow the gas to flow to the burner 10 as soon as the control button 13 is released and the gas emitting at the burner 10 will be ignited by the pilot flame 15.

In the event of a malfunction, the pilot flame 15 will extinguish causing the cooling of the thermocouple 16; and under such circumstances the safety valve 11 will close so to terminate the gas flow to both the pilot nozzle 12 as well as the burner 10 to prevent the leakage of un-ignited gas into the barbeque unit; and under such condition when the large accumulation of gas in the barbeque unit is ignited it will cause an explosion hazard.

Figure 2:
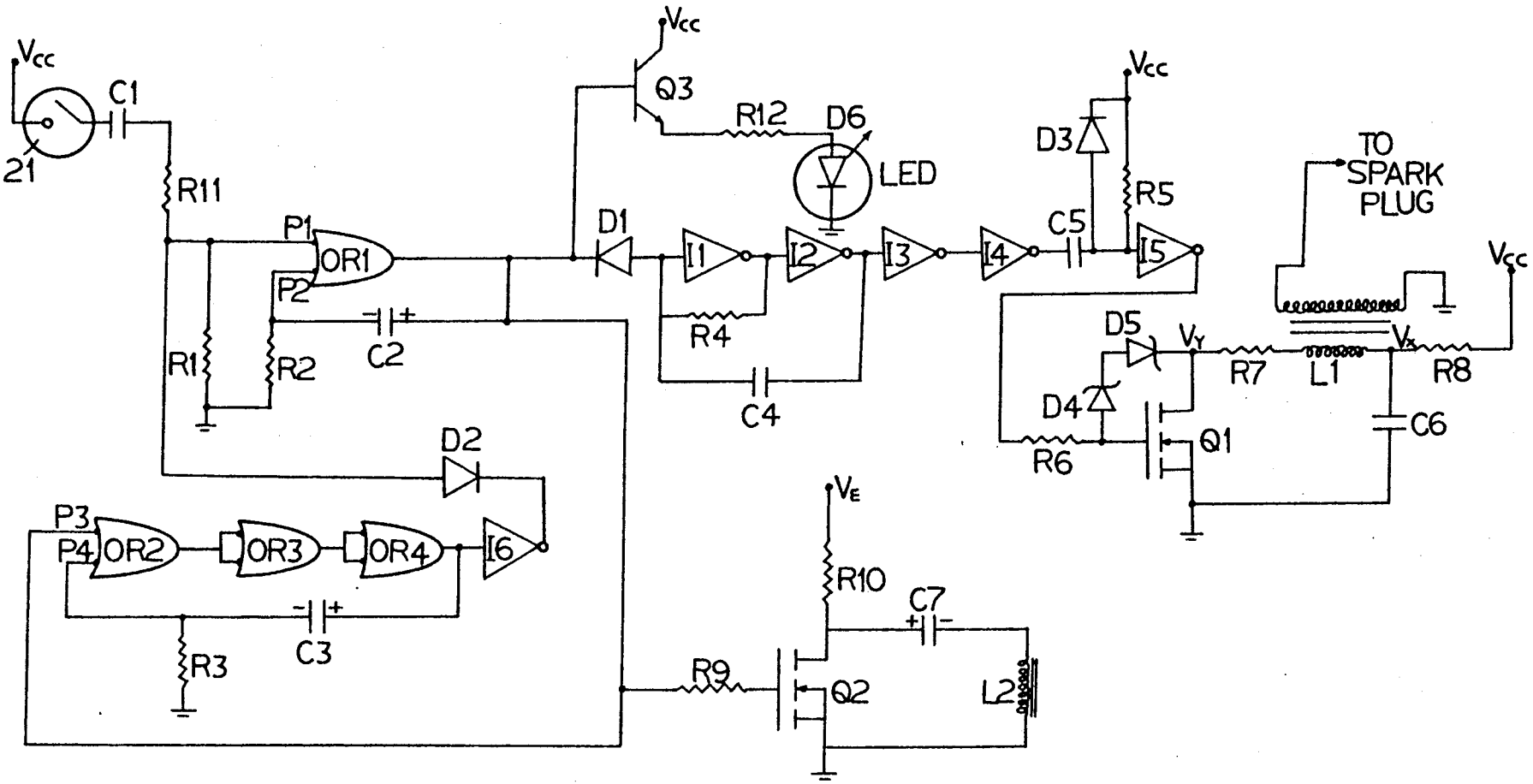
FIG. 2 is a schematic diagram of the electrical circuit of the gas barbeque igniting system thereof.

As best shown in FIG. 2 the timer/control unit 20 according to the present invention comprises a CMOS device such as a QUAD 2-input OR gate having OR gates OR1, OR2, OR3 and OR4, the input terminal P1 of the OR gate OR1 is connected to a low voltage supply such as a 9-volt battery through the series connected capacitor C1, resistor R1, and the control switch 21. OR gates OR2, OR3 and OR4 of the CMOS device are connected in series to form a cascaded OR gate. The input terminal P2 of the OR gate OR1 is connected to the input terminal P3 of the cascaded OR gate through a dump capacitor C2 and to the negative polarity of the supply voltage source through a discharge resistor R2. The input terminal P1 of the OR gate OR1 is also connected to the negative polarity of the supply voltage source through a discharge resistor R1. The output of the cascaded OR gate is fed back to the input terminal P4 through a threshold capacitor C3 and the input terminal is also connected through a resistor R3 to the negative polarity of the voltage supply source. The output signal of the cascaded OR gate is fedback to the input terminal Pl of the OR gate OR1 through an inverter 16 and a blocking diode D2.

In operation, the timer/control unit 20 is energized by closing the control switch 21 to allow the supply voltage to flow into the circuit. The control switch 21 may be a manually operated switch or a remotely controlled switch. The latter is preferred in that it provides the convenience for the user to ignite the burner of the barbeque unit in a safe remote position. Such remote operative system provides further security to the user that in case of any unexpected occurrence of explosion of the appliance unit, the user is located safely and remotely from the appliance.

When the control switch 21 is closed, the supply voltage Vcc will flow through the input capacitor C1 and resistor R1 to the input terminal pl of the OR gate OR1 making the potential at the terminal pl high momentarily and, in turn, the output potential of OR gate OR1 is high. The high potential is fed back to the input terminal P2 through the dump capacitor C2 until the dump capacitor C2 discharges its threshold potential through the discharge resistor R2. The charging and discharging of the dumP capacitor C2 may preferably be chosen to occur in about 15 seconds. The reason for such discharge time will become apparent in the description to follow.

When the output potential of the OR gate OR1 is positive, the voltage potential at the input terminal P3 of the cascaded OR gate will be positive which, in turn, makes the output potential at the output of the cascaded OR gate to be positive and the input terminal P4 will become positive momentarily until the threshold capacitor C3 discharges through the resistor R3 to the threshold voltage. The charging and discharging of the threshold capacitor C3 is preferably to be about 3 minutes. Such selected time again will become apparent in later description.

When the input to the inverter I6 is high, its output becomes low which, in turn, causes the potential at the input terminal P1 of the OR gate OR1 to be low, and the blocking diode D2 will maintain the potential at the input terminal P1 so that for the selected period of 3 minutes interval the OR gate OR1 can not be energized by any further signal by closing the control switch 21.

When the output potential of the OR gate OR1 is high for about 15 seconds, the potential at the base of the transistor Q3 becomes high, resulting in current flowing through the resistor R12 to energize the LED indicator D6 to show that the system is in operation.

The output signal of the timer/control unit 20 is fed to the spark generator 24 through a diode D1. The spark generator 24 comprises an oscillator and a drive circuit. Due to the low voltage requirement of the present circuit, the oscillator may consist of a simple CMOS HEX inverter having inverters I1, I2, I3, I4 and I5. The inverters I1 and I2 are connected with a feedback resistor R4 and a capacitor C4 so as to provide an oscillator which is designed to provide oscillating output signals of about 2 times per second. The oscillating output signals are transformed into square wave signals by inverters I3 and I4.

Each time the output potential of the inverter I4 becomes low, the input potential of the inverter I5 becomes low until the capacitor C5 is charged to about half of the potential of the input voltage Vcc through the resistor R5. In the present application, this period is designed to be about 5 milliseconds. In this 5 milliseconds period when the input potential of the inverter I5 is low, its output potential will be high. This high potential will flow through the resistor R6 to turn on the transistor Q1 which may be a high voltage breakdown VMOS or NPN transistor. When the transistor Q1 is turned on, current will flow through the resistor R7 to the input coil L1 and the voltage at the terminal Vx of the input coil, which is connected to the positive polarity of the input voltage Vcc through the resistor R8, is approximately equal to the input voltage Vcc. When the transistor Q1 turns off, the voltage on its drain terminal Vy goes high which, due to the back emf of the primary coil L1 of the ignition coil 25, may be in the level of approximately 250 volts in this application. Zener diodes D4 and D5 are connected between the drain terminal and the gate terminal of the transis-tor Q1 to protect it in case the voltage goes much higher. The combined reverse breakdown voltage of zener diodes D4 and D5 are selected so that they are slightly lower than the drain to source breakdown voltage of the transistor Q1. If the voltage at the drain terminal Vy goes higher than the combined zener voltage of zener diodes D4 and D5 it will turn on the transistor Q1 thus limiting the voltage at the drain terminal Vy. The 250 volts pulse at the primary coil L1 of the ignition coil 25 is transformed into a much higher voltage in its secondary coil which is connected to the spark plug 26 to generate a spark therefrom for igniting the gas emitting from the pilot nozzle 12. According to the above selected timings in the timer/control unit, in the 15 seconds period that the output of the OR gate OR1 is high, it results in producing about 30 sparks at the spark plug 26.

The electromagnetic safety drive circuit 23 comprises a VMOS or NPN transistor Q2 having an input resistor R9 connected to its gate terminal. Its drain terminal is connected to the positive polarity of the input voltage Vcc through a resistor R1O and is connected to the electromagnetic actuator 22 through a charging capacitor C7. Its other drain terminal is connected to the negative polarity of the input voltage Vcc and the actuator 22. When the output of the OR gate OR1 in the timer/control unit 20 is high it also turns on the transistor Q2 in the drive circuit 23 via the input resistor R9. When the transitor Q2 is turned on it causes the charging capacitor C7 to discharge through the electromagnetic actuator 22. This capacitor causes current to flow through the actuator 22. The current will decrease in value until about 12 seconds when it is sufficiently low to release the actuator. In accordance with the present invention, when the output of the OR gate OR1 goes low in about 15 seconds initially the transistor Q2 will turn off. This allows the charging capacitor C7 to be charged to the potential equal to the supply voltage Vcc via the resistor R10. The charging time is about 3 minutes. It can be appreciated that the safety feature of this drive circuit is that if any component is malfunctioning either due to open circuit or short circuit, the actuator 22 can not be energized for longer than 15 seconds. In any event, the chances of a circuit failure are extremely remote. Because if the resistor 10 breaks down, it will become open-circuited to terminate all current flowing to the actuator 22; and if, in the unlikely event that, the charging capacitor C7 becomes short circuited, the current through the resistor R10 is sufficiently low so that it cannot maintain the energization of the actuator 22. If the transistor Q2 is short circuited, no current will flow through the coil L2 of the actuator 22 once it has discharged the capacitor C7. Thus, even a combination of faults can not result in the actuator 22 from being energized to allow the gas to flow through the safety valve 11 to either the pilot nozzle 12 or the burner 10 or both. Also, since the only failure mode of the blocking resistor R9 and R10 is open circuited which will result in the actuator 22 from not being energized, accidental opening of the safety valve 11 will not occur due to any circuit failure.

Figure 3:
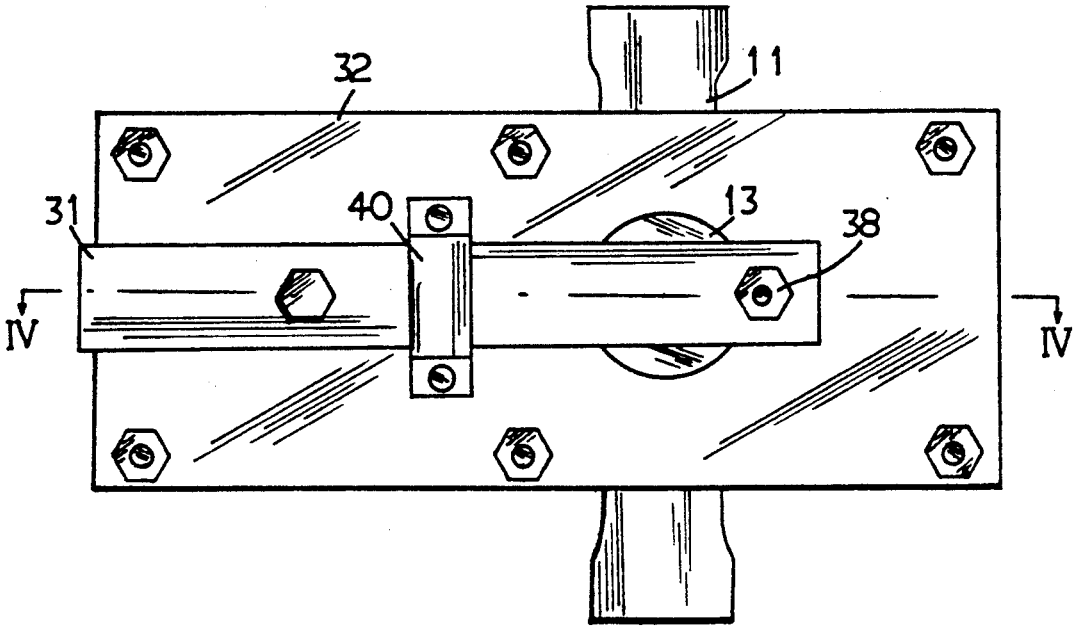
FIG. 3 is a top elevation view of the electromagnetic actuator according to the present invention.
Figure 4:
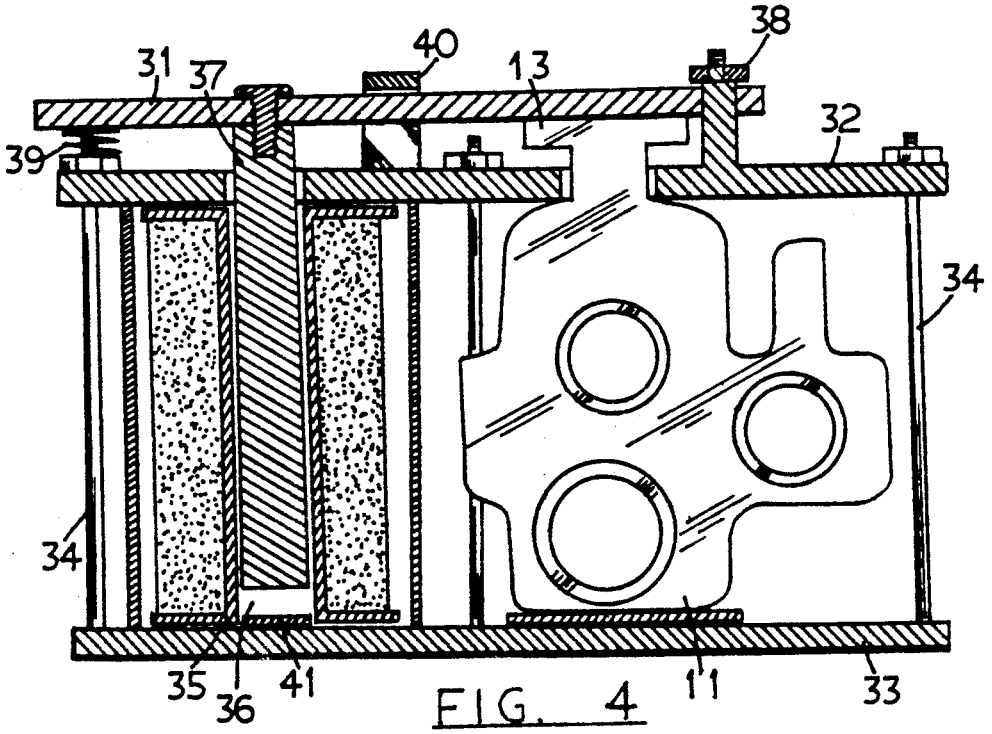
FIG. 4 is a partial section side elevation view of the electromagnetic actuator along section line VI—VI of FIG. 3

The construction of the actuator 22 will now be described with reference to FIGS. 3 and 4. The actuator 22 primarily comprises an electromagnetic solenoid 30 which is operative to cause a spring-biassed bar 31 to press downwards on the control button 13 of the safety valve 11. The solenoid 30 is mounted to the safety valve 11 by an upper plate 32 and a lower plate 33 by a plurality of bolts 34. The solenoid consists of magnet wire windings wound on a bobbin 35. The center of the bobbin 35 has a longitudinal housing 36 adapted to receive a magnetizable plunger 37 slidably disposed therein. The upper end of the plunger 37 is mounted to the bar 31. One end of the bar 31 is slidably mounted to a post 38 located on the top plate 32. A biassing spring 39 is provided at the underside of the other end portion of the bar 31 such that the bar 31 may be pressed downwards by sliding along the post 38, and it will return to its original upper position by the tension force of the biassing spring 39 when the pressing pressure is released. The bar 31 is prevented from sideway movements by an inverted U-shaped bracket 40 mounted over the upper plate 32. When the actuator 22 is energized by the drive circuit 23, the solenoid 30 attracts the plunger 37 into the housing 36 causing the bar 31 to press downwards on the control button 13 of the safety valve 11 so as to permit the gas to flow from the supply to the pilot nozzle 12 for ignition by the spark plug 26.

A thin spacer 41 may be provided at the bottom of the center housing 36 of the solenoid 30 to serve as a small air gap so as to prevent the plunger 37 from being captured within the housing 36 by any residual magnetic force in the solenoid 30. It can be appreciated by those skilled in the art that due to the simple construction of the actuator 22 it can be produced easily and inexpensively.

To extinguish the burner in the barbeque unit, it is merely required to short out the thermocouple 16 so as to de-energize the safety valve 11. This can be simple achieved by shorting the thermocouple 16 with a manual shorting switch mounted on the gas barbeque unit.

Figure 5:
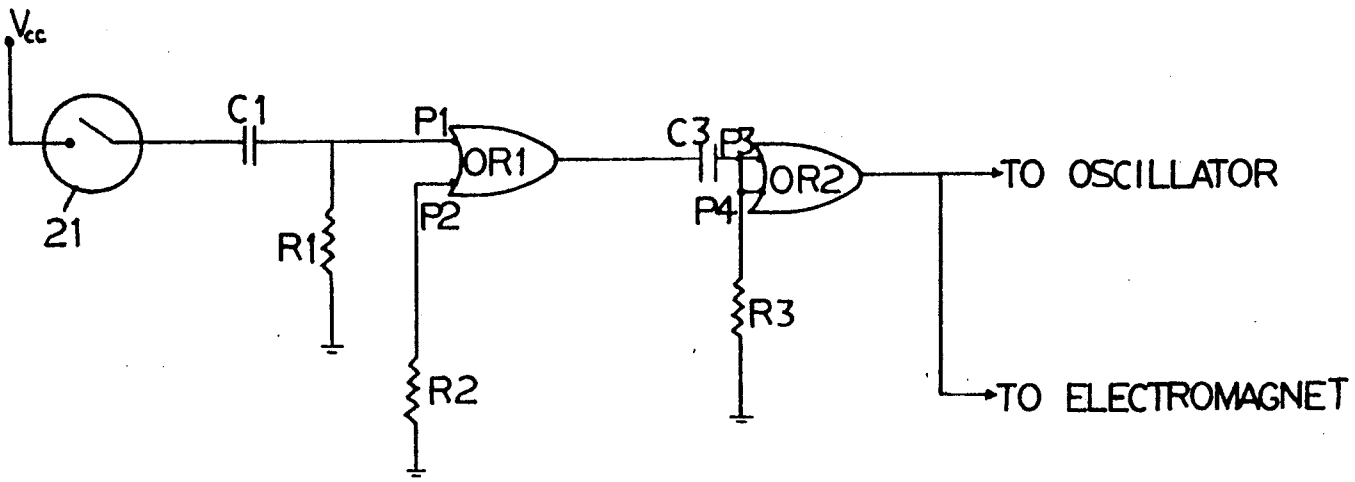
FIG. 5 is a schematic circuit diagram of the alternate timer/control circuit according to the present invention.

The timer/control circuit of the present invention may be alternatively as shown in FIG. 5 in which the 15 second timer consists of a single OR gate OR2. The input terminals P3 and P4 of the OR gate OR2 are commonly connected. The output of the 3-minute blocking circuit from the OR gate OR1 is fed to the input terminals of the OR gate OR2 through the charging capacitor C3. The input terminals of the OR gate OR2 are connected to the second polarity of the input voltage through the discharge resistor R3.

When the potential at the input terminal P1 of the OR gate OR1 goes high momentarily, the potential at the output terminal of the OR gate OR1 goes high. The charging capacitor C2 and resistor R2 provides a 3-minute time while the output potential of the OR gate OR1 is high; thus blocking any further input pulse from activating the timer during this time period. The potential at the input terminals P3 and P4 of the OR gate OR2 remains high until the capacitor C3 discharges through the resistor R3. The time of charging and discharging of the capacitor C3 is designed to be about 15 seconds. Thus, it provides a 15 second time period in which the output potential of the OR gate OR2 is high.

While the invention has been particularly shown and described with reference to preferred embodiments thereof, it will be understood by those skilled in the art that various changes in form and details may be made therein without departing from the spirit and scope of the present invention.

What is claimed is:

1. An electromechanical ignition system for a gas burner comprising, p1 a safety valve means having a main valve therein operative to admit a combustible gas burner comprising, a safety valve means having a main valve therein operative to admit a combustible gas to flow therethrough from a supply source to said burner, said safety valve means having a pilot lighter nozzle means and a control means operative to admit said combustible gas to flow through said safety valve means to said pilot lighter nozzle means for ignition to form a pilot flame, heat sensing means adapted at said safety valve means and operative for sensing existence of said pilot flame for a predetermined period of time and in cooperation with said control means for maintaining said main valve in an open condition, electromagnetic means coupled to said control means and operative to actuate said control means.

timer means coupled to said electromagnetic means through a driver means, and operative to actuate said electromagnetic means for said period of time, spark generation means coupled to said timer means and operative to generate a series of sparks over said perdetermined period of time at said pilot lighter nozzle means for forming said pilot flame whereby igniting the combustible gas emitting from said burner, said timer comprising a pulse generating means operative to generate a series of pulse signals and a holding signal simultaneously in said predetermined period of time, said series of pulse signal being converted by said spark generation means into said series of sparks, and said holding signal being fed to said driver means for operating said electromagnetic means for said predetermined period of time, said driver means including a safety driver circuit means coupled between said timer means and said control means, said driver circuit means having a regulating means being operative in cooperation with said control means in an event of accidental extinction of said pilot flame to maintain said electromagnetic means inoperative for a longer period than said predetermined period of time.

2. An electromechanical ignition system according to claim 1 wherein said timer means includes a plurality of OR gate means operative to maintain said timer means to function only over said predetermined period of time and being non-responsive to any further actuation by said switching means within said predetermined period of time.

3. An electromechanical ignition system according to claim 2 wherein said plurality of OR gate means comprises a first OR gate means having a first input terminal, a second input terminal and an output terminal, said first input terminal being connected to one polarity of an input voltage through said switching means, a first feedback capacitor means connected to said second input terminal and to said output terminal, a first discharge resistor means connected to said second input terminal and to a second polarity of said input voltage, a second OR gate means, a third OR gate means and a fourth OR gate means connected in series forming a cascaded OR gate means, having a first input terminal, a second input terminal and an output terminal, a second feedback resistor means connected between said first input terminal of said cascaded OR gate means, a second discharge resistor means connected between said first input terminal of said cascaded OR gate means and said second polarity of input voltage, said second input terminal of said cascaded OR gate means being connected to said output terminal of said first OR gate means, said output terminal of said cascaded OR gate means being connected to said first OR gate means through a first inverter means and a reverse blocking diode means.

4. An electromechanical ignition system according to claim 3 wherein said driver means comprises a transistor means having a base terminal, a drain terminal and an emitter terminal, said base terminal being connected to said output terminal of said first OR gate means through a second blocking resistor, said drain terminl being connected to a polarity of an operating voltage, said emitter terminal being connected to a second polarity of said operating voltage, said electromagnetic means having one terminal connected to said emitter terminal and a second terminal connected to said drain terminal through a charging capacitor means.

5. An electromechanical ignition system according to claim 4 wherein said timer means includes an indicator means operative to indicate the actuation of said timer means, said indication means comprising a second transistor means having a base terminal connected to said output terminal of said first OR gate means, a drain terminal connected to said one polarity of input voltage, and an emitter terminal connected to the second polarity of input voltage through a series resistor and a light emitting diode means.

6. An electromechanical ignition system according to claim 5 wherein said spark generation means comprises an oscillator means and a square wave generation means, said oscillator means comprising a first inverter means having an input terminal and an output terminal, a second inverter means having an input terminal and an output terminal, said input terminal of said first inverter means being connected to said output terminal of said first OR gate means through a blocking diode means, and said output terminal of said first inverter means being connected to said input terminal of said second inverter means, a feedback resistor means connected between said input terminal and output terminal of said first inverter means, a second feedback capacitor means connected between said output terminal of said second inverter means and said input terminal of said first inverter means, said output terminal of said second inverter means being connected to an input terminal of series connected third inverter means and fourth inverter means, said fourth inverter means having an output terminal connected to an input terminal of a fifth inverter means through a selected charging capacitor means, said input terminal of said fifth inverter means being connected to said one polarity of input voltage through a bias resistor means.

7. An electromechanical ignition system according to claim 6 wherein said square wave generation means comprises a third transistor means having a base terminal, a drain terminal and an emitter terminal, said base terminal of said third transistor means being connected to an output terminal of said fifth inverter means through a second blocking resistor means, a first zener diode means and a second zener diode means being connected in series and connected between said drain terminal and base terminal of said third transistor means, an ignition transformer means having primary coil having one terminal connected to said emitter terminal of said third transistor means through a dumping capacitor means, and said primary coil having a second terminal connected to said drain terminal of said third transistor means through a second bias resistor means, said one terminal of said primary coil also connected to said one polarity of input voltage, and said emitter terminal of said third transistor means being connected to said second polarity of input voltage, second ignition transformer means having a secondary coil connected in parallel to a spark plug means, and said spark plug means having an arcing gap operative to generate a spark to ignite said gas emitting from said pilot lighter nozzle means to form said pilot flame.

8. An electromechanical ignition system according to claim 7 wherein said plurality of OR gate means is a CMOS device.

9. An electromechanical ignition system according to claim 8 wherein said first inverter means to fifth inverter means are integrally formed within a CMOS HEX device.

10. An electromechanical ignition system according to claim 1 wherein said electromagnetic means comprises a solenoid means having a plunger member slidably mounted therein, a bar means mounted to said plunger member and operative to actuate said control means, biassing means coupled to said bar means and operative to return said bar means to a normal position when said solenoid means is de-energized.

11. An electromechanical ignition system according to claim 2 wherein said plurality of OR gate means comprises a first OR gate means having a first input terminal, a second input terminal, and an output terminal, said first input terminal being connected to one polarity of an input voltage through a series connected input capacitor means and said switching means, an input resistor means connected between said first input terminal and a second polarity of said input voltage, a first feedback capacitor means connected to said second input terminal and to said output terminal, a first discharge resistor means connected to said second input terminal and to said second polarity of said input voltage, a second OR gate means having a first input terminal, a second input terminal and an output terminal, said first input terminal and second input terminal of said second OR gate means being connected at a common point, a discharge capacitor means connected between said common point and said output terminal of said first OR gate means, a second discharge resistor means connected between said common point and said second polarity of said input voltage, and said output terminal of said second OR gate means being connected to said electromagnetic means and said spark generation means.

12. An electromechanical ignition system according to claim 4 wherein said timer means includes a remote controllable switching means operative to actuate said timer means.

* * * * *